US006032434A

United States Patent [19]

Graf

[11] Patent Number: 6,032,434

[45] Date of Patent: Mar. 7, 2000

[54] HALF-TIMBER FRAME AND HALF-TIMBER COMPARTMENT ELEMENT

[75] Inventor: Dragica Graf, Taubertalweg 6, 91541 Rothenburg o.d.T., Germany

[73] Assignee: Dragica Graf, Rothenburg, Germany

[21] Appl. No.: 09/029,626

[22] PCT Filed: Sep. 4, 1996

[86] PCT No.: PCT/DE96/01649

§ 371 Date: May 8, 1998

§ 102(e) Date: May 8, 1998

[87] PCT Pub. No.: WO97/09492

PCT Pub. Date: Mar. 13, 1997

[30] Foreign Application Priority Data

Sep. 6, 1995 [DE] Germany ..... 195 32 829
Jul. 11, 1996 [DE] Germany ..... 196 28 043

[51] Int. Cl.[7] ..... E04C 2/34

[52] U.S. Cl. ..... 52/794.1; 52/309.9; 52/309.11; 52/364; 52/376; 52/784.15; 52/630

[58] Field of Search ..... 52/309.9, 309.11, 52/794.1, 797.1, 801.11, 630, 364, 376, 784.15; 428/537.1, 319.1, 223

[56] References Cited

U.S. PATENT DOCUMENTS

| | | | |
|---|---|---|---|
| 2,238,022 | 4/1941 | Johnson | 52/309.9 |
| 2,307,918 | 1/1943 | Cope | 428/537.1 |
| 3,141,206 | 7/1964 | Stephens | 428/537.1 |
| 3,192,098 | 6/1965 | Phillips | 428/537.1 |
| 3,712,004 | 1/1973 | Loebsack | 52/309.9 |
| 3,785,913 | 1/1974 | Hallamore | 52/309.9 |
| 4,147,004 | 4/1979 | Day et al. | 52/309.9 |
| 5,135,597 | 8/1992 | Barker | 428/537.1 |
| 5,192,598 | 3/1993 | Forte et al. | 428/537.1 |

FOREIGN PATENT DOCUMENTS

| | | | |
|---|---|---|---|
| 0 388 507 | 9/1990 | European Pat. Off. . | |
| 2 583 802 | 12/1986 | France . | |
| 826347 | 12/1951 | Germany . | |
| 2204731 C2 | 8/1982 | Germany . | |
| 3924088 A1 | 1/1991 | Germany . | |
| 59944 | 8/1947 | Netherlands | 248/351 |
| 56226 | 5/1920 | Sweden . | |
| 400 598 | 4/1978 | Sweden . | |
| 228595 | 9/1943 | Switzerland . | |
| 2 052 596 | 1/1981 | United Kingdom . | |

*Primary Examiner*—Christopher T. Kent
*Assistant Examiner*—Dennis L. Dorsey
*Attorney, Agent, or Firm*—Oliff & Berridge, PLC

[57] ABSTRACT

What is disclosed is a half-timber frame, compartment elements for a like half-timber frame, and a method for producing a compartment element, wherein boards of small-dimension timber are utilized for producing the half-timber frame supports as well as the compartment elements, such that a product which is considerably more economical than conventional solutions while having comparable thermal and acoustic insulation is obtained.

8 Claims, 16 Drawing Sheets

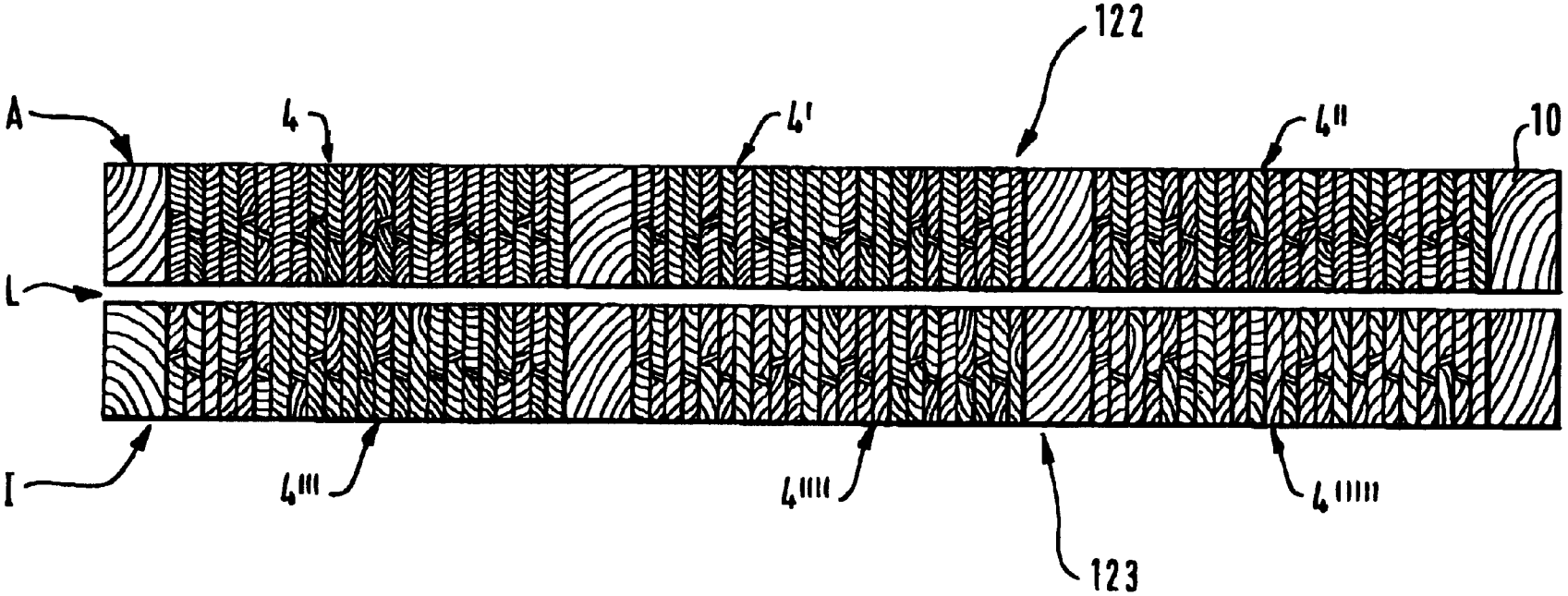
Fig. 23
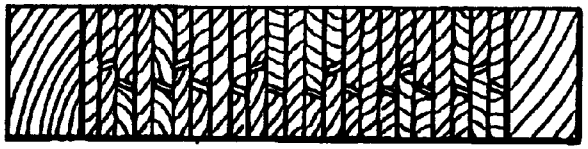

HALF-TIMBER FRAME AND HALF-TIMBER COMPARTMENT ELEMENT

BACKGROUND OF THE INVENTION

1. Field of the Invention

The invention concerns a half-timber frame for supporting a compartment element in accordance with the preamble of claim 1, wall elements for a like half-timber frame and a method for producing a compartment element.

2. Description of the Related Art

Half-timber construction has been employed for centuries to construct domestic buildings, wherein one half-timber frame interstice is formed by vertical members, transverse members (top member, bottom member) and possibly diagonal members and filled with suitable wall or compartment elements. Whereas the half-timber frame is designed with a view to static strength, the compartment elements are generally adapted for optimum thermal insulation. In old half-timber constructions these compartment elements were formed of clay/brick elements or other mineral construction materials.

Nowadays the half-timber construction method can still be found in wooden structures, with the half-timber frame being produced of solid wooden beams, whereas the compartment elements are commonly comprised of two panel-type sheathing layers spaced apart from each other, and the space between these sheathing layers being filled by loose fill or foamed insulation.

For producing the half-timber supports for the half-timber frame, beams representing the core wood of small-dimension timber are used, so that a certain minimum thickness of the log is required for obtaining a beam having the predetermined dimensions and the predetermined strength. To this end the external layers of the tree must be sawed off until the parallelepipedic base shape of the beam having smooth outer surfaces is obtained. This production method has the drawback of giving rise to considerable amounts of logging waste which, at best, is generally further comminuted and processed into chip boards or other low-quality products.

The half-timber frame construction method in its conventional form moreover requires careful drying of the hearwood of small-dimension timbers, because in the case of insufficiently dried half-timber supports there is a risk of their warping owing to variations of temperature and humidity, and of the half-timber walls consequently developing cracks.

It is a drawback of the compartment elements employed in the conventional half-timber frame construction method that only an inadequate strength may be obtained. In the cases of loose fill insulation and foam insulation the interstices may happen to be not filled entirely, whereby only an insufficient or non-uniform insulation effect can be obtained. In particular compartment elements containing loose filling material can subsequently be worked only at greatest difficulty because any cutting to the compartment element may bring about at least partial leaking of the filling material. It is another drawback of the known compartment elements that small animals, such as martens or small rodents, can penetrate into the space between the two sheathing layers.

SUMMARY OF THE INVENTION

In view of the above, the invention is based on the object of furnishing a half-timber frame and a compartment element for a like half-timber frame, wherein sufficient strength and thermal/acoustic insulation may be obtained at minimum expenditure of material. This object is attained by the features of claim 1 concerning the half-timber frame, and by the features of claims 6 and 14, respectively, concerning the compartment elements. Claim 12 relates to a method for producing a compartment element in accordance with claim 6. The half-timber frame according to the invention, developed by Ms. D. Graf, is to be named "Half Timber 2000".

The half-timber frame according to the invention is distinguished in that the half-timber supports (for example, transverse member, vertical member, diagonal member) are to be produced of a plurality of interconnected boards, thereby also permitting the use of small-dimension timber for constructing the half-timber supports, something which has not been possible in the conventional construction method as the cross-section of the small-dimension timber was too small for producing integral beams having the required cross-sectional dimensions.

Whereas in the conventional half-timber frame method the corner connection of the half-timber supports was achieved by mortise and tenon joints worked into the solid material of the heart wood and thus required a considerable work effort for their production, the tenons and mortises can be formed in an easy manner by interrupting or prolonging the boards in the solution according to the invention. The half-timber supports may thus, in comparison with the conventional construction method, be manufactured in a considerably more economical manner because on the one hand small-dimension timbers classified II or III may be used which hitherto had not been designated for the like high-quality applications, and on the other hand the work effort for obtaining the mortises and tenons (grooves and tongues) could be simplified quite substantially in comparison with the conventional construction method.

Inasmuch as heart wood is not utilised for the half-timber frame of the present invention, cracking and deformation of the beams of the half-timber frame cannot take place. The construction according to the invention also makes it possible to contribute a major amount of private work effort to the construction, whereby the overall construction costs may be reduced.

The half-timber supports can be produced in a particularly simple manner if they are formed of three strips, i.e., one center strip and two outer strips sandwiching the latter. As a result of this triple-layer—or optionally multiple-layer—construction of the half-timber supports, the mortises of the members can be produced by shortening, setting back or recessing the center strips, and the tenons can be produced by setting back the outer strips in the longitudinal or crosswise direction in accordance with any desired combination of features of claims 3 to 5.

The first compartment element used for the like half-timber frames in accordance with the invention has a stratified structure, with each stratum being comprised of a layer of boards, an insulation layer formed thereon, and a layer of spacer slats. On this layer of spacer slats, in turn, the next stratum consisting of a layer of boards, an insulation layer and another layer of spacer slats is supported. Herein it is particularly preferred if the layer of spacer slats rests on the insulation layer, so that the latter may be applied in full surface contact on the layer of boards.

The two sheathing layers of the compartment elements are in a preferred embodiment each formed by one layer of boards, wherein the spacer slats ensure the layer of boards to have the predetermined distance throughout. Because the insulation layer is applied in full surface contact and held by the spacer slats, shifting of the insulation and thus a non-uniform insulation effect is precluded.

The spacer slats have the further advantage that small animals cannot penetrate into the spaces between the sheathing layers.

For producing the layer of boards it is again possible to utilise small-dimension timbers classified II and III, so that the material costs for obtaining the compartment element should be substantially lower than for conventional compartment elements in which either high-quality timber was used for the sheathing layers or, on the other hand, inexpensive pressed materials which compare unfavorably with the layer of boards according to the invention in terms of strength as well as insulation effect.

Depending on the specific application, further final layers may be formed as visible surfaces on one or both sheathing layers (external layers of boards). In this final layer it is then possible to form recesses for receiving sanitary/air conditioning/electrical installations.

Interconnection of the single layers of a compartment element is advantageously achieved through suitable connecting means, such as nails or clamps.

Independent claim 12 concerns a particularly simple method for producing the above named compartment element according to the invention.

In this method, a mounting frame on which a first layer of boards is initially applied is preferably used in the case of old buildings. In the case of new buildings, a wall structure already produced beforehand is made use of as a mounting frame. An insulation layer preferably having the form of an insulating mat is then applied on this layer of boards. Subsequently the spacer slats are applied with their longitudinal axis extending crosswise with respect to the longitudinal axis of the boards. This is followed by further strata, wherein it is preferred to provide a total of three strata of boards, insulation layer and layer of spacer slats. On the layer of spacer slats of the n-th layer, a final layer of boards is then applied as a top layer. The completed stratified structure is then subjected to pressing to slightly compress the insulation layers, wherein it is provided to compress each insulation layer by approximately 5 to 10 mm. The stratified structure thus compressed is then fixed suitable of suitable connecting means, such as for instance clamps or nails, with the result that the structure forcibly produced by the pressing step will be preserved following relaxation of pressure.

In a final work step the compartment element may be cut to measure, wherein unfilled cavities practically cannot occur owing to the full-surface insulation layer and the multiple subdivision by the spacer slats, and the required strength is furthermore preserved.

In the second compartment element according to the invention a stratified structure is also formed by a multiplicity of contiguous transverse layers, with each transverse layer being formed by two wooden boards each having three processed peripheral edges and one bark edge. The wooden boards for each transverse layer are arranged with the bark edges in facing opposition to each other, so that the outer edges of the transverse layer are formed by the peripheral edges of the two wooden boards. In other words, in this relative arrangement of the two wooden boards the two bark edges form a separating gap extending approximately along the center line of the transverse layer.

This separating gap may in an advantageous embodiment be filled with insulation material.

The transverse layers are connected to each other along their major surfaces by means of suitable connecting means, e.g., adhesive or nails or clamps.

Space for installing supply lines and conduits may be formed by omitting one or several adjacent wooden boards of the transverse layers.

The compartment elements according to the invention may be employed to particular advantage as wall, ceiling or roofing panels.

Further advantageous developments of the invention form the subject matters of the remaining appended claims.

BRIEF DESCRIPTION OF THE DRAWINGS

Preferred embodiments of the invention shall be described herebelow by reference to schematic drawings, wherein:

FIG. 23 shows a cross-section of a wall having particularly good insulation which consists of compartment elements in accordance with FIG. 17.

DETAILED DESCRIPTION OF THE PREFERRED EMBODIMENT

Figure 1:
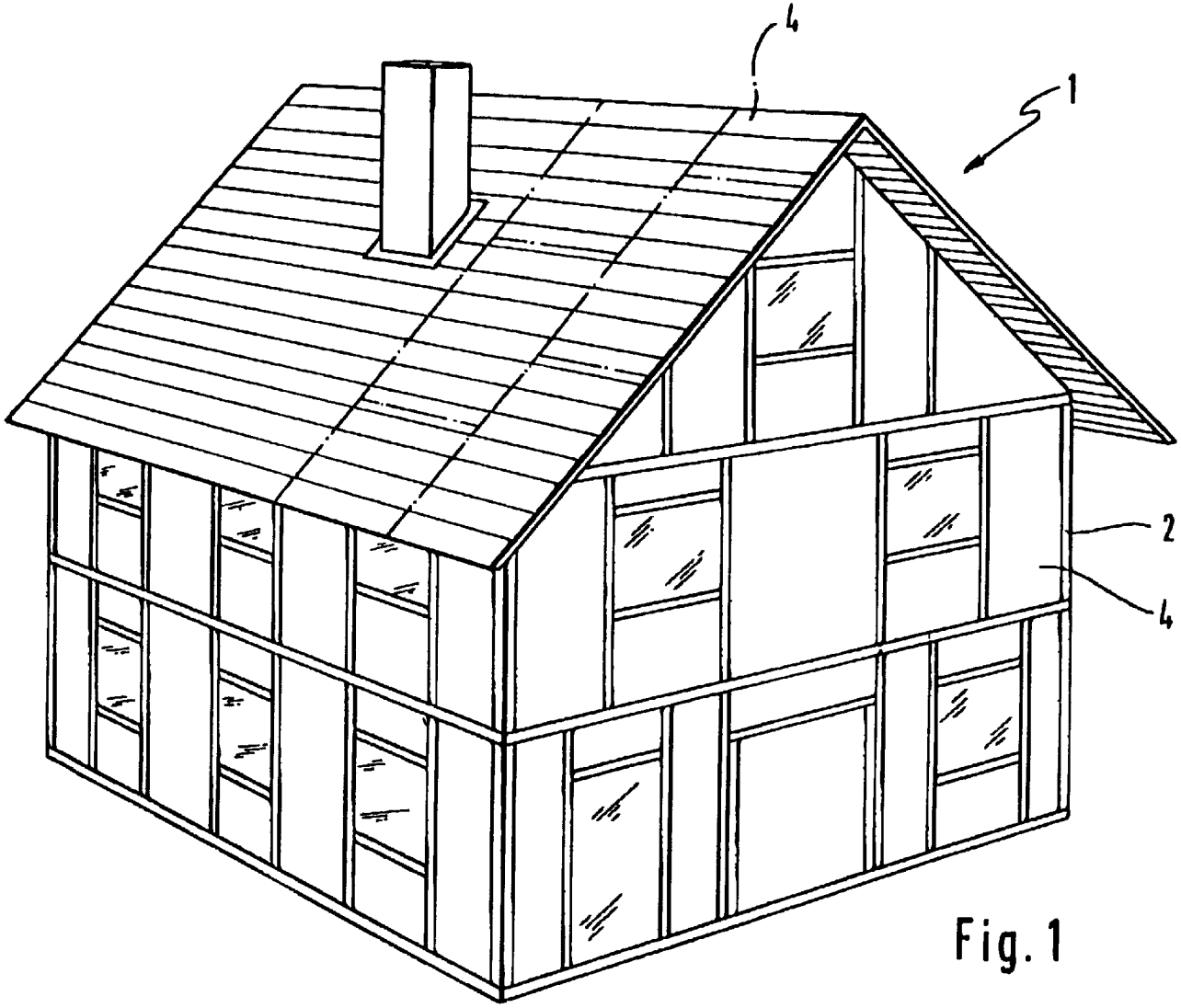
FIG. 1 is a schematic representation of a wooden half-timber frame house.

FIG. 1 shows a strongly simplified three-dimensional representation of a wooden house 1 produced by the half-timber frame construction technique.

The walls of the wooden house 1 are formed by a half-timber frame structure 2, resulting in the formation of a multiplicity of half-timber frame interstices or half-timber frame compartments filled by compartment elements 4. As can be seen from the dash-dotted lines in FIG. 1, portions of the roof structure may also be formed of compartment elements 4 in accordance with the invention. As a matter of fact, the floor and ceiling structures (ground floor, upper floor) may also be formed of the half-timber frame according to the invention which is filled with a suitable embodiment of compartment elements 4.

Figure 2:
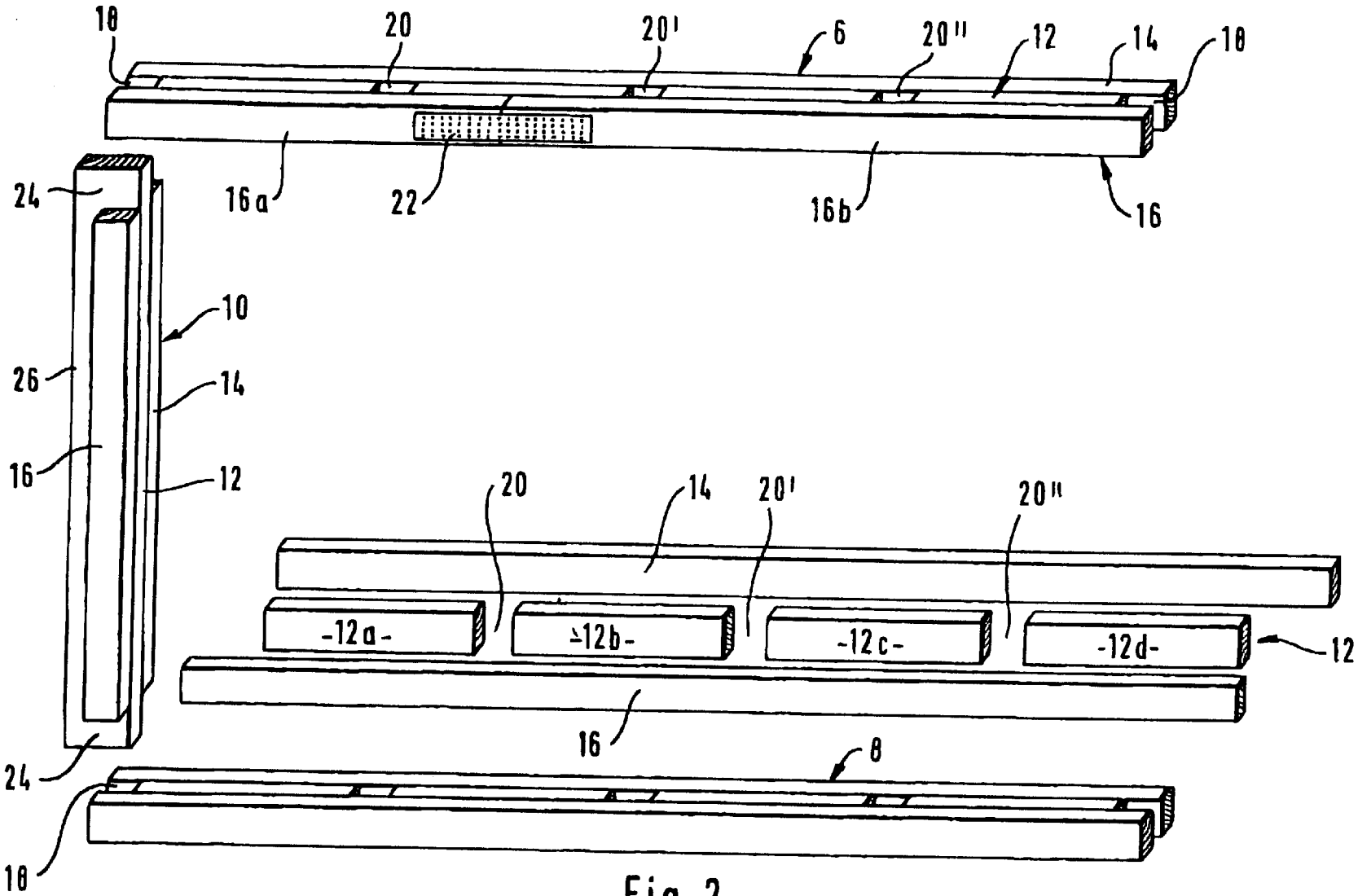
FIG. 2 is a partly exploded representation of a half-timber frame.

FIG. 2 schematically shows the main structural components of a half-timber frame. A half-timber frame intended for supporting a single compartment element 4 comprises two transverse members 6, 8 (upper member, lower member) forming the upper and lower delimitation of the half-timber frame compartment. The two transverse members 6, 8 are connected by vertical members, with only the left-hand vertical member 10 being shown in the representation of FIG. 2. The right-hand vertical member, besides being rotated around the longitudinal axis by 180°, basically has the same structure as the vertical member 10.

It is a common feature of the members 6, 8 and 10 that they have a triple layer structure of three layers of strips or boards. Hereinafter the boards of the single layers shall be referred to as strips, with the term "strips" designating wooden profiles preferably produced of small-dimension timbers. Each member 6, 8, 10 consists of a center strip 12 and two outer strips 14, 16 arranged on either side of the center strip 12. Interconnection of the strips 12, 14, 16 is obtained by suitable connecting means such as for example nails or clamps (not shown).

As can be seen in FIG. 2, the front-side end portions of the outer strips 14, 16 of each transverse member 6 are prolonged beyond the respective adjacent end portion of the center strip 12, resulting in the formation of a central recess at the front surfaces of the transverse member 6 which serves as a mortise 18 for a tenon and mortise connection.

Depending on the width of the transverse member 6, the center strip 12 may moreover be formed to have one or several intermissions 20, 20', 20", with these intermissions also serving as mortises for receiving a tenon for connection of the half-timber frame.

As is moreover indicated at the upper transverse member 6, the outer strips 16 in the case of long transverse members 6 may also be produced of components 16*a*, 16*b* which are connected to each other by means of a connection plate 22.

This variation of construction also makes it possible to use short small-dimension timbers, such that up to 70% of a decorticated log classified as small-dimension timber of classes II and III can be used for producing the half-timber frame.

In the case of the vertical member 10 represented on the left side in FIG. 2, the center strip 12 is prolonged in comparison with the two outer strips 14, 16 on either side in the axial direction, whereby one tenon 24 each is formed by the projection portion of the center strip 12, which matches the mortises 18 at the end portions of the transverse member 6.

The two outer strips 14, 16 are furthermore in the transverse direction (crosswise to the longitudinal axis) set back behind the center strip 12, resulting in the formation of a longitudinal tenon 26, constituted by the projecting lateral edge of the center strip 12, along the left-hand (view of FIG. 2) longitudinal edge.

The half-timber frame schematically indicated in FIG. 2 may be joined together in a simple manner by inserting the tenon 24 of the lateral parts 10 into the associated mortises 18 and subsequently carrying out respective fixation by means of nails, screws or clamps.

As in the half-timber frame in accordance with FIG. 2 three more mortises 20, 20', 20" are formed by comparatively short center strip elements 12*a*, 12*b*, 12*c* and 12*d* spaced apart from each other, logging waste or very short small-dimension timber elements may be utilised as center strips in a particularly advantageous manner.

In FIGS. 3 to 6 further embodiments of vertical members capable of insertion in this type of half-timber frame are represented.

Figures 3, 4, 5, 6:
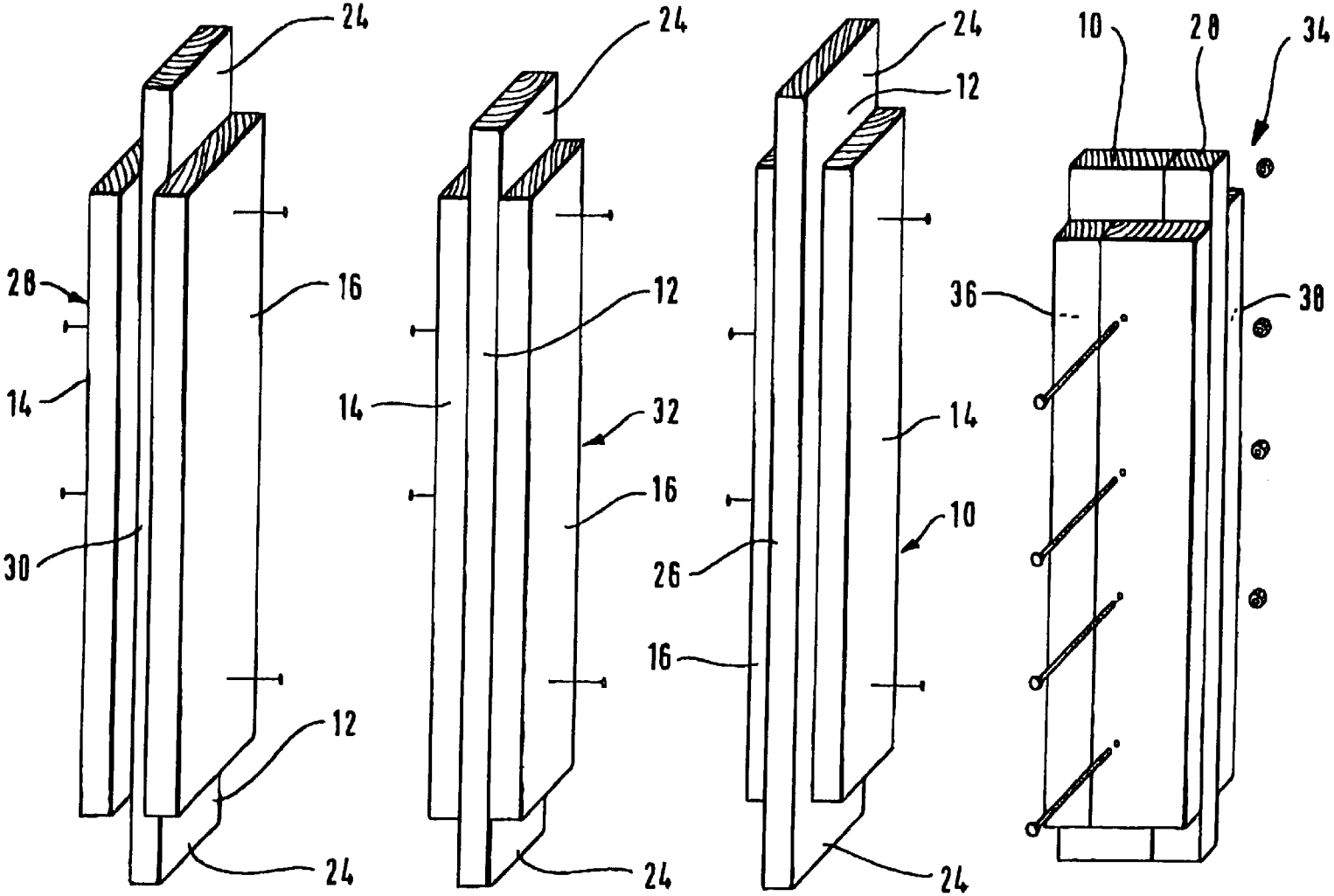
FIGS. 3 to 6 show members of the half-timber frame of FIG. 2.

FIG. 3 shows a vertical member 28 wherein the center strip 12 projects beyond the two outer strips 14 and 16 on either side in the longitudinal direction, so that at the front-side end portions in turn two tenons 24 are formed. Other than in the case of the vertical member 10 of FIG. 2, the center strip 12 is set back behind the outer strips 14, 16 in the transverse direction, resulting in the formation of a longitudinal mortise 30 at the lateral edge of the vertical member 28, for insertion of the longitudinal tenon 26 of the vertical member 10 of FIG. 2.

FIG. 4 shows an intermediate member 32 for a half-timber frame in accordance with FIG. 2, wherein the intermediate member 32 may be inserted into the mortises 20, 20', 20". In this type of intermediate member 32, only the center strip 12 is on either side formed to be longer than the two outer strips, resulting in formation of the tenons 24 at the front-side end portions for insertion into the mortises 20, 20', 20".

FIG. 5 shows the vertical member 10 of FIG. 2 from a different direction of view, wherein—as was mentioned above—this vertical member 10 may be used for left-hand and right-hand delimitation of a half-timber frame.

By joining together the vertical members shown in FIGS. 3 and 5, i.e. by inserting the longitudinal tenon 26 into the longitudinal mortise 30, a corner element 34 as shown in FIG. 6 may be produced. The vertical members 10, 28 of the corner element 34 are joined together by screw connections 36 or by other suitable connecting means.

On the corner element 34 constituted by the vertical members 10 and 28, two contact surfaces 36 and 38 for the lateral edges of the compartment element 4 are formed.

Figure 7:
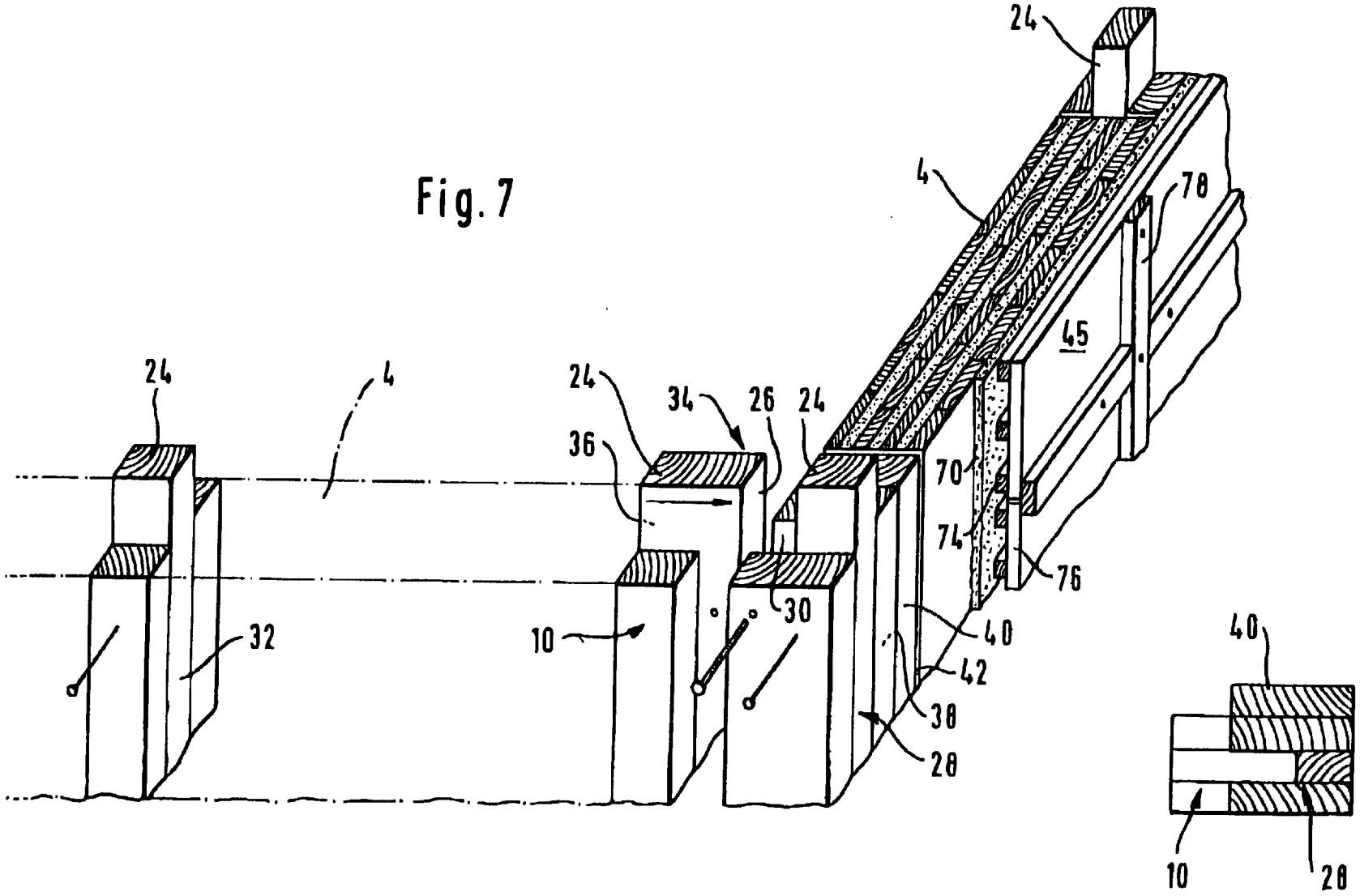
FIG. 7 shows the corner area of a half-timber construction.

FIG. 7 shows a corner area of a half-timber frame structure, with the corner element 34 being formed by a vertical member 10 including the longitudinal tenon 26 and the vertical member 28 including the longitudinal mortise 30 into which the longitudinal tenon 26 penetrates.

The contact surface 36 formed on the vertical member 10 is then contacted by a compartment element 4 merely indicated in FIG. 7, which in turn extends as far as an intermediate member 32 in accordance with FIG. 4.

On the abutting surface 38 of the vertical member 28 a spacer strip 40 may optimally be provided, which in turn is followed by a compartment element 4 the construction of which shall be described in more detail herebelow. Between the spacer strip 40 and the compartment element 4, i.e., between the abutting surfaces 36 and the compartment element 4, a suitable intermediate layer such as for example a mineral fiber layer or PU foam may be provided.

The upper termination of the corner area represented in FIG. 7 is in turn achieved by transverse members 6 the mortises (18–20") of which are placed over the associated tenon 24.

The compartment element represented in FIG. 7 is provided with an outer sheath 45 which shall be described in more detail further below.

Figure 8:
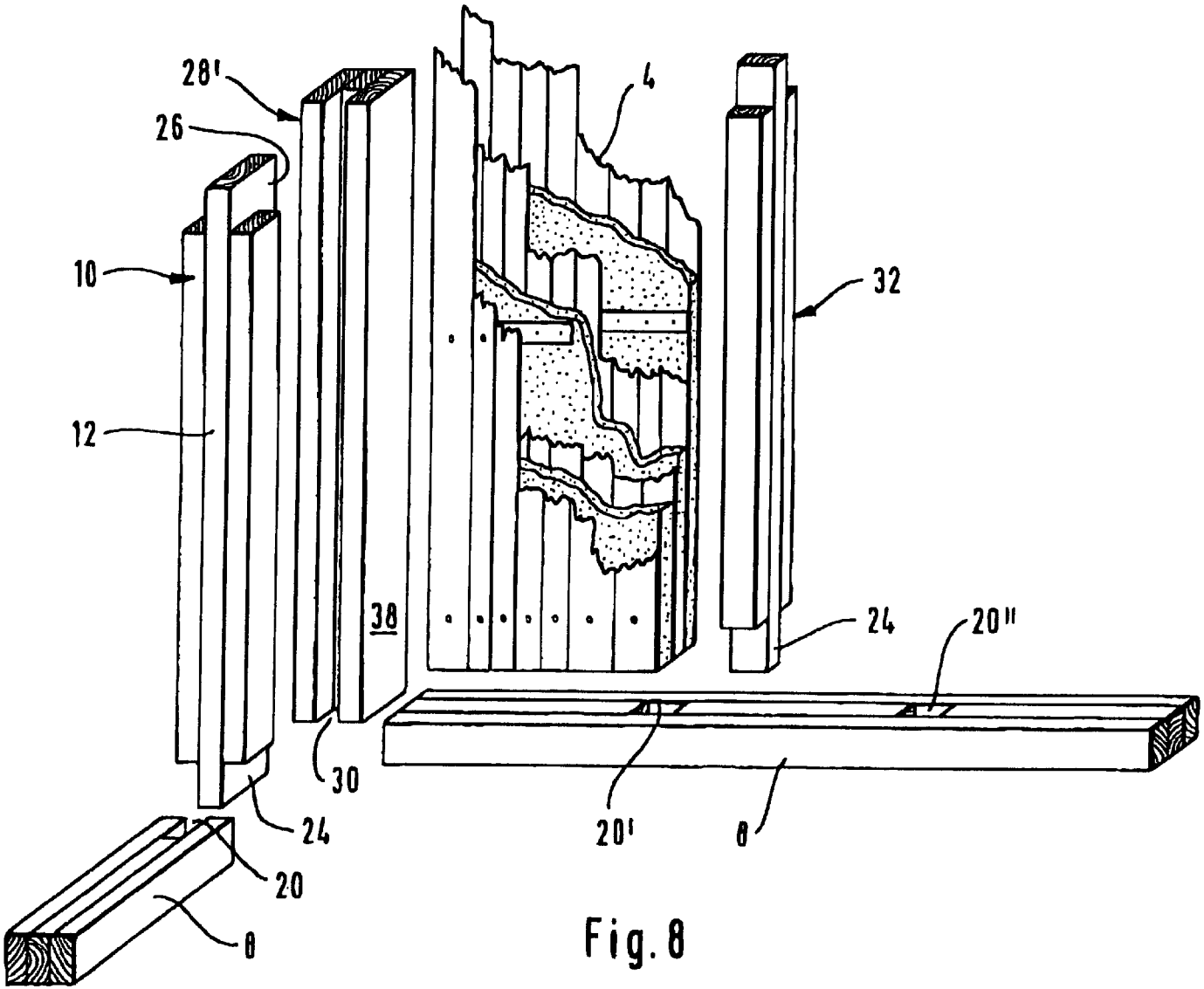
FIG. 8 is a three-dimensional representation of a corner area of a half-timber construction.

FIG. 8 is a three-dimensional representation of a corner area seen from the inside. Just as in the above described half-timber frame area, the corner element 34 is formed by the vertical member 10 including a longitudinal tenon 26 and a vertical member 28' including a longitudinal mortise 30. The vertical member 28' of FIG. 8 differs from the vertical member 28 of FIG. 3 in that the two tenons 24 are not formed, so that the total height of the vertical member 28' is equal to the length of the center strip 12 of the vertical member 10.

The tenons 24 of the vertical member 12 are introduced into the associated recesses 20 of the lower left-hand (FIG. 8) transverse member 8. The transverse member 8 having a horizontal orientation in FIG. 8 is in flush contact with the contact surface 38 of the vertical member 28'. The tenon 24 of an intermediate member 32 is introduced into the recess 20' of this transverse member 8 so that the compartment element 4 can be inserted between the intermediate member 32 and the vertical member 28 and the upper (FIG. 8) surface of the transverse member 8.

Figure 9:
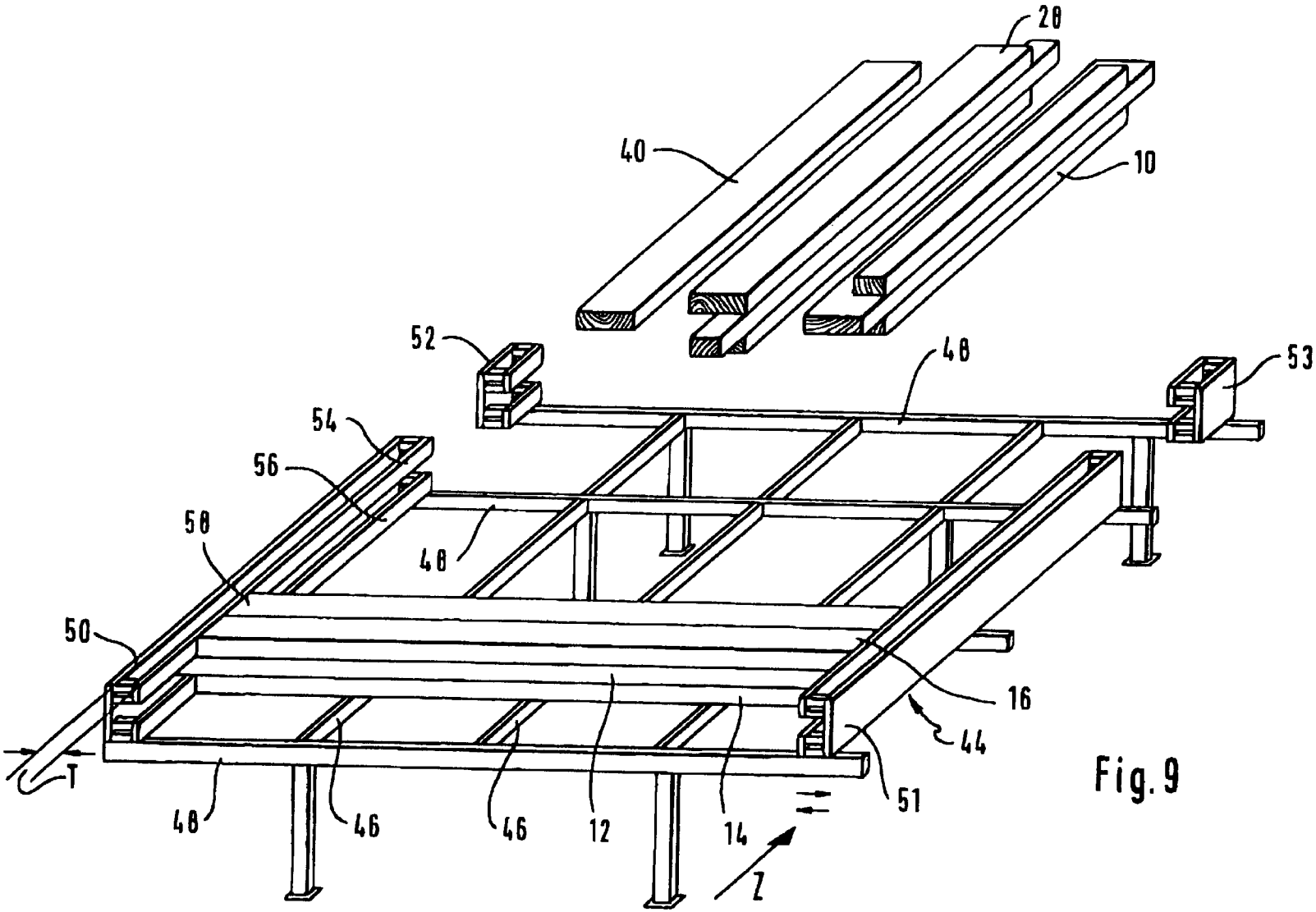
FIG. 9 shows a mounting frame for assembling the members of the half-timber frame of FIGS. 3 to 5.

FIG. 9 shows a mounting table 44 which can be used for assembling the vertical members and transverse members 6 and 8 represented in FIGS. 3 to 5.

This mounting table 44 is produced of square profiles as a coffered structure, with longitudinal profiles 46 and transverse profiles 48 jointly forming a support grid for the strips of the members.

On the end portions of the transverse profiles 48, end parts 50 to 53 extending approximately in parallel with the longitudinal profiles 46 are formed.

These end parts include two stopper slats 54, 56 extending at parallel spacing and in the longitudinal direction (parallel to the longitudinal profile), between which a space corresponding to the wall thickness of a center strip 12 is formed. The depth T of the stopper strips 54 corresponds to the length of the tenons 24.

In order to allow for production of various lengths of members, the end parts 51 and 53 are arranged on the associated transverse profiles 48 such as to be slidable.

For producing the members, initially an outer strip 14 is set on the longitudinal profiles 46, with the length of the outer strip 14 corresponding to the spacing of the end parts 50 and 51, so that the front surfaces of the outer strip 14 contact the stopper slat 56. Next, a center strip 12 is inserted in the direction of the arrow Z between the two stopper slats 54, 56 until it is positioned in the predetermined relative arrangement on the outer strip 14 already set in position. In other words, in this reference position the two end portions of the center strip 12 penetrate into the space between the two stopper slats 54 and 56. Next, an outer strip 16 is placed between the end parts 50, 51, positioned with reference to the center strip 12 and the outer strip 14 and subsequently connected by means of suitable connecting means (adhesive, nail, clamp). The frame according to the invention ensures formation of the boards 12, 14, 16 at uniform dimensions and in their predetermined relative positioning, thereby doing away with the need for any type of finishing work. In order to ensure accuracy of angles, the frame may in addition be provided with a transverse stopper 58 to which the longitudinal edges of the strips may be contacted.

Figure 10:
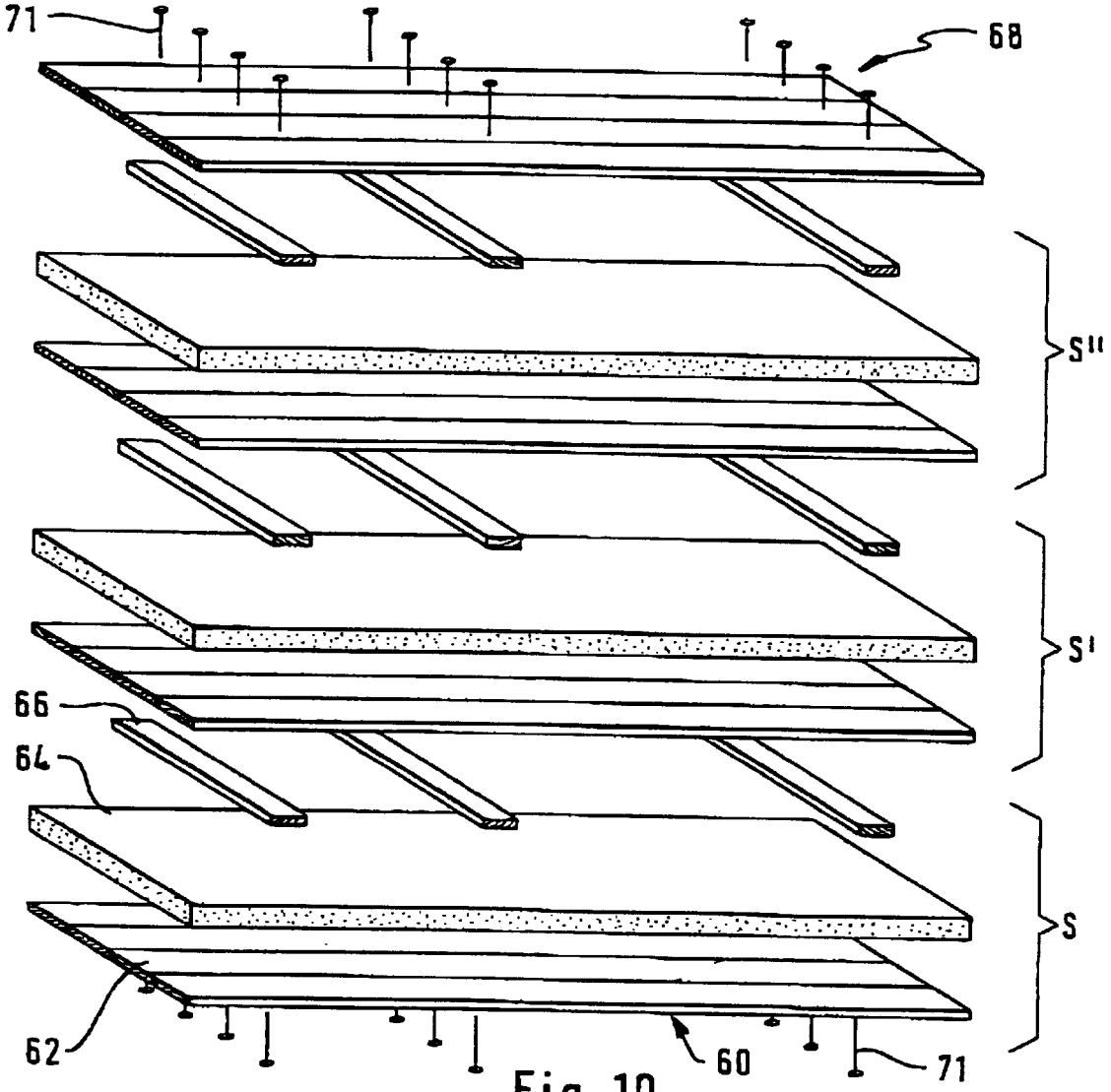
FIG. 10 shows the stratified structure of a first embodiment of a compartment element for the half-timber frame of FIG. 1.
Figure 11:
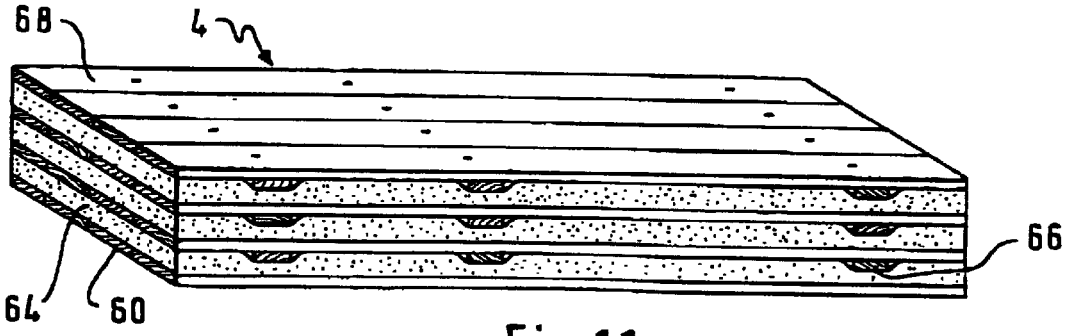
FIG. 11 is a three-dimensional representation of the compartment element of FIG. 10.

In FIGS. 10 and 11 a first embodiment of a compartment element 4 according to the invention is represented.

FIG. 10 shows an exploded view of a stratified compartment element comprising three strata.

Each stratum S consists of a layer of boards 60 formed of a multiplicity of contiguous boards 62 which in turn are produced of small-dimension timber. On the layer of boards 60 an insulation layer 64, e.g., conventional mat-type insulation material by Rockwool®, or natural materials, such as for example sheep's wool or straw panels etc., is applied. The insulation layer 64 may furthermore be provided with a vapor barrier.

A multiplicity of spacer slats 66 arranged at a parallel spacing from each other are then set onto this insulation layer 64, with their longitudinal axes extending crosswise to the longitudinal axes of the boards 62. This stratum S is then followed by two additional strata S' and S" which, in turn, have the same structure as the stratum S. The external top layer of the compartment element 4 is formed by a final layer of boards 68 having a structure that corresponds to the other three layers of boards of the compartment element 4.

As was already mentioned at the beginning, this stratified structure is compressed by suitable pressing means and subsequently coupled together by means of nails 71 or other suitable connecting means which extend through the boards 62, the spacer slats 66 and the insulation layer 64.

As the insulation layer 64 is formed continuously throughout, formation of thermal bridges between the adjacent layers of boards 60 is reduced to minimum, whereby excellent thermal insulation may be obtained. Owing to the stratified structure and the comparatively large mass, excellent acoustic insulation is furthermore achieved by the compartment element 4 in accordance with the invention.

The finished compartment element 4 is represented in FIG. 11, with the outer sheathing layers being formed by the layer of boards 60, or the final layer of boards 68. FIG. 11 shows that the insulation layers 64 are formed continuously while having a smaller layer thickness in the range of the spacer slats 66, with the resulting degradation of the insulation effect, however, being negligible. As a result of providing the spacer slats 66, small animals cannot penetrate into the spaces between the layers of boards 60, whereby the respective drawbacks of the prior art are also eliminated. The compartment elements 4 may be produced in any desired sizes, with a standard element having a length of 2400 mm, a width of 600 mm and a thickness (in the finished state) of approx. 190 mm. A like compartment element 4 has a weight of about 68 kg/m$^2$. The heat transition coefficient K is 2.76 W/m2*K. The compartment element corresponds to fire classification F30.

This compartment element 4 was also inserted into the half-timber frame-structure in accordance with FIG. 8.

One of the external layers of boards 60, 68 may be provided with an outer sheath 45 (cf. FIG. 7). The outer sheath 45 may, for example, consist of a chip board 70 (cf. FIG. 7), backup strips 74 arranged thereon and panels 76 fastened thereto, with their abutting edges being concealed by joint covers 78. As such outer sheaths 45 are already known from the prior art, further explications may be omitted.

Figure 12:
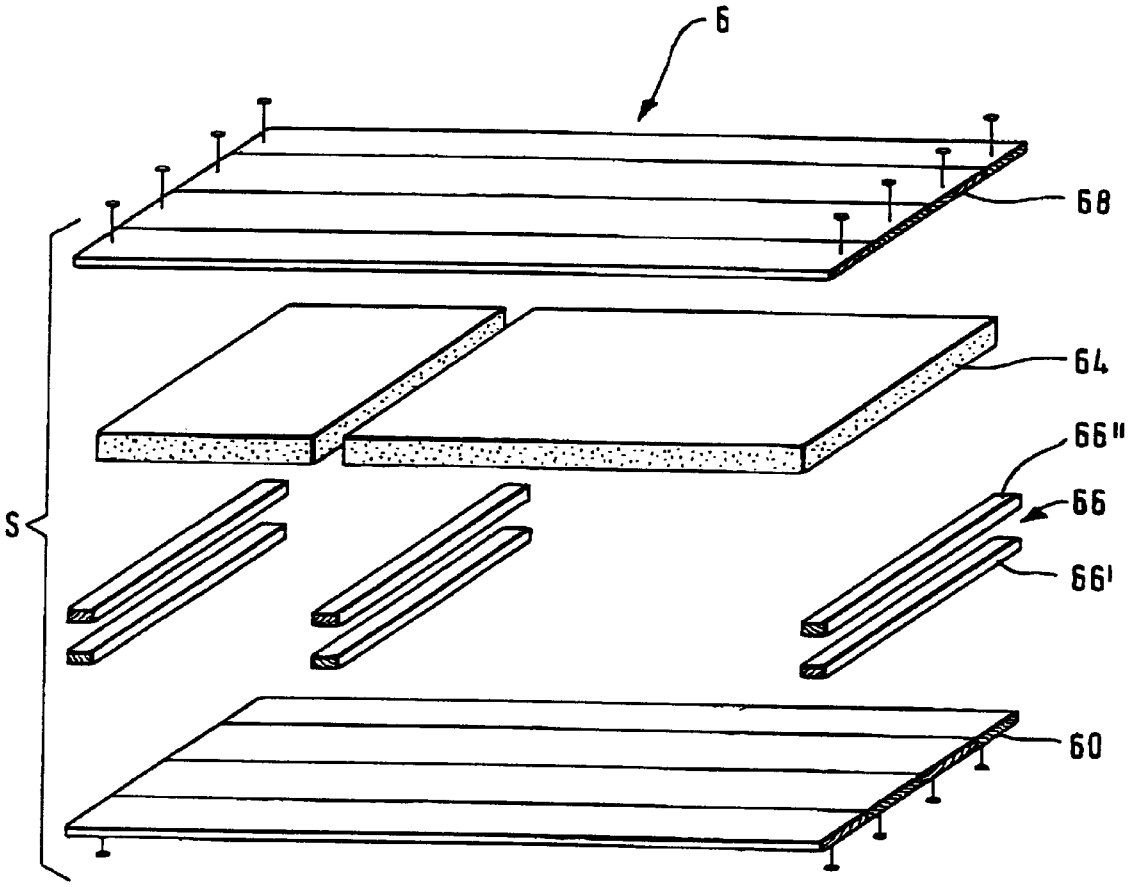
FIG. 12 shows another embodiment of this compartment element as a nonbearing wall.

FIG. 12 shows another embodiment of a compartment element 4 according to the invention which may, for example, be used for forming nonbearing, lightweight inner walls. In the case of this lightweight compartment element 4 only one stratum S is formed which in turn is comprised of a layer of boards 60, spacer slats 66, an insulation layer 64 and a final layer of boards 68. Other than in the embodiment described above, the insulation layer 64 is not formed continuously over the entire cross-section of the layer of boards 60, 68 but only between the adjacent spacer slats 66, so that no insulation is provided in the area of the spacer slats. In the interior range such weakening of the insulation layer is, however, acceptable. Each spacer slat 66 may be formed by two superposed spacer slat elements 66', 66".

Production of the compartment element in accordance with FIG. 12 is effected in the same manner as for the compartment element 4 described above, so that further explanations may be omitted.

Figure 13:
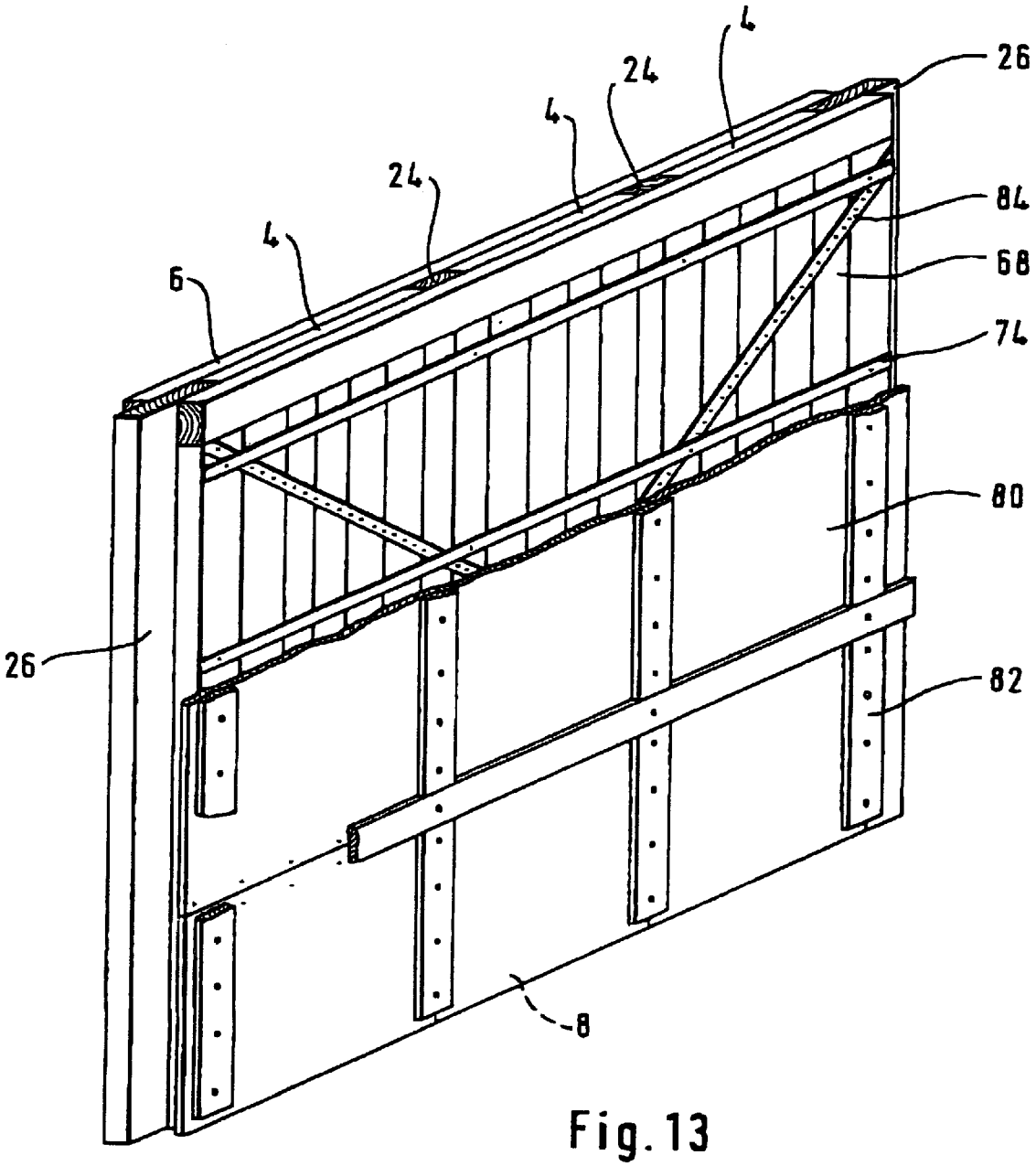
FIG. 13 shows an embodiment as an outer wall.

FIG. 13 shows an outer wall formed by implementing the half-timber frame system according to the invention. I.e., the half-timber frame is laterally defined by two vertical members 26, at its upper end portion by a transverse member 6, and at its lower end portion by a transverse member 8 which is not visible, with the width of the interstices in the half-timber frame being defined by intermediate members 24 which are fastened to the transverse members 6, 8 (cf. FIG. 2).

The half-timber frame compartments formed in this way are filled by means of three compartment elements 4. The layers of boards 68 of the three compartment elements 4 and the adjacent lateral surfaces of the members 6, 8, 26, 24 define a flush, largely planar outer surface on which backup strips 74 extending crosswise to the longitudinal direction of the layers of boards 68 is fastened. On the backup strips an external panelling layer 80 is fastened, with the separating gaps of the external panelling being covered by covers 82 representing a half-timber skeleton.

In order to stabilise the connection, connecting bands 84 extending across the application surface for the backup strips 74 may furthermore be applied which, in the embodiment represented in FIG. 13, extend in the diagonal direction.

Figure 14:
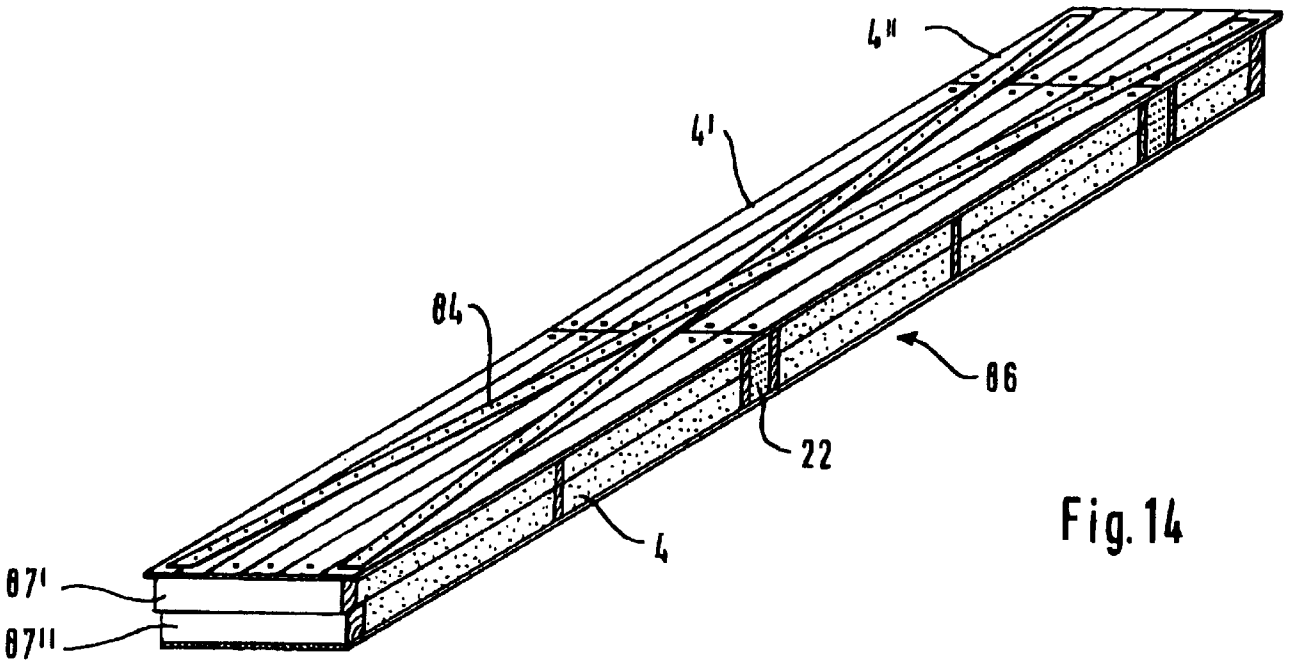
FIGS. 14 to 16 show an embodiment of the compartment element as a roofing element.
Figure 15:
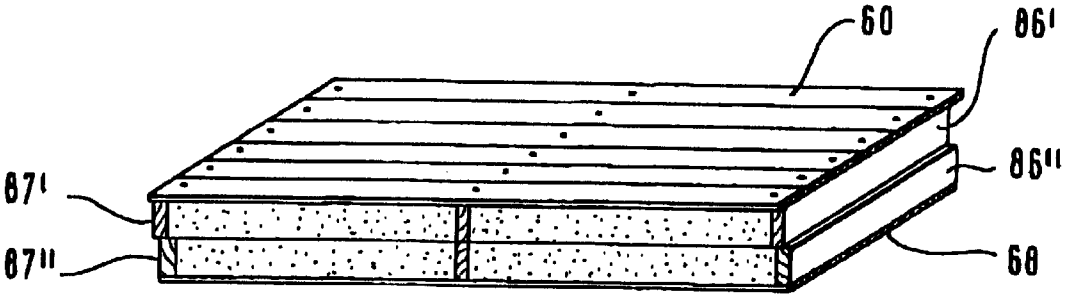

In FIGS. 14 and 15 a roofing element 86 formed of several compartment elements 4, 4', 4" is represented. Interconnection of the compartment elements 4, 4', 4" is effected by means of connecting bands 84 applied on the sheathing layers which are formed by the layers of boards 60, 68. At the lateral edges of the compartment elements 4, 4', in turn, connection plates 22 are provided which are fastened to front-side square timbers. As is particularly shown in FIG. 15, the front-side termination of each compartment element 4 is formed by two squared timbers 86', 86" arranged on top of each other (view of FIG. 15), which jointly form a step or a joint. On the other front side, two square timbers 87', 87" are also provided in staggered arrangement, with the step on the right-hand front side in FIG. 15 facing upward (FIG. 15), whereas the step on the left-hand front side faces downward, so that upon front-side joining of such compartment elements 4 an abutting contact section between two adjacent compartment elements 4, 4' is created. The stratified structure of compartment elements 4, 4', 4" may in any desired manner be achieved by using one or several strata S in accordance with the described embodiments.

Such roofing elements present the advantage that the inside of the roof does not require panelling any more. It is only necessary in this case to provide backup strips for accommodating the roof tiles or some other type of roofing on the layer of boards forming the outer wall.

It is, of course, possible to form a vapor barrier on the inner layer of boards in a known manner and apply a sheet which is open to diffusion on the outer layer of boards to thereby ensure optimum insulation against humidity.

Figure 16:
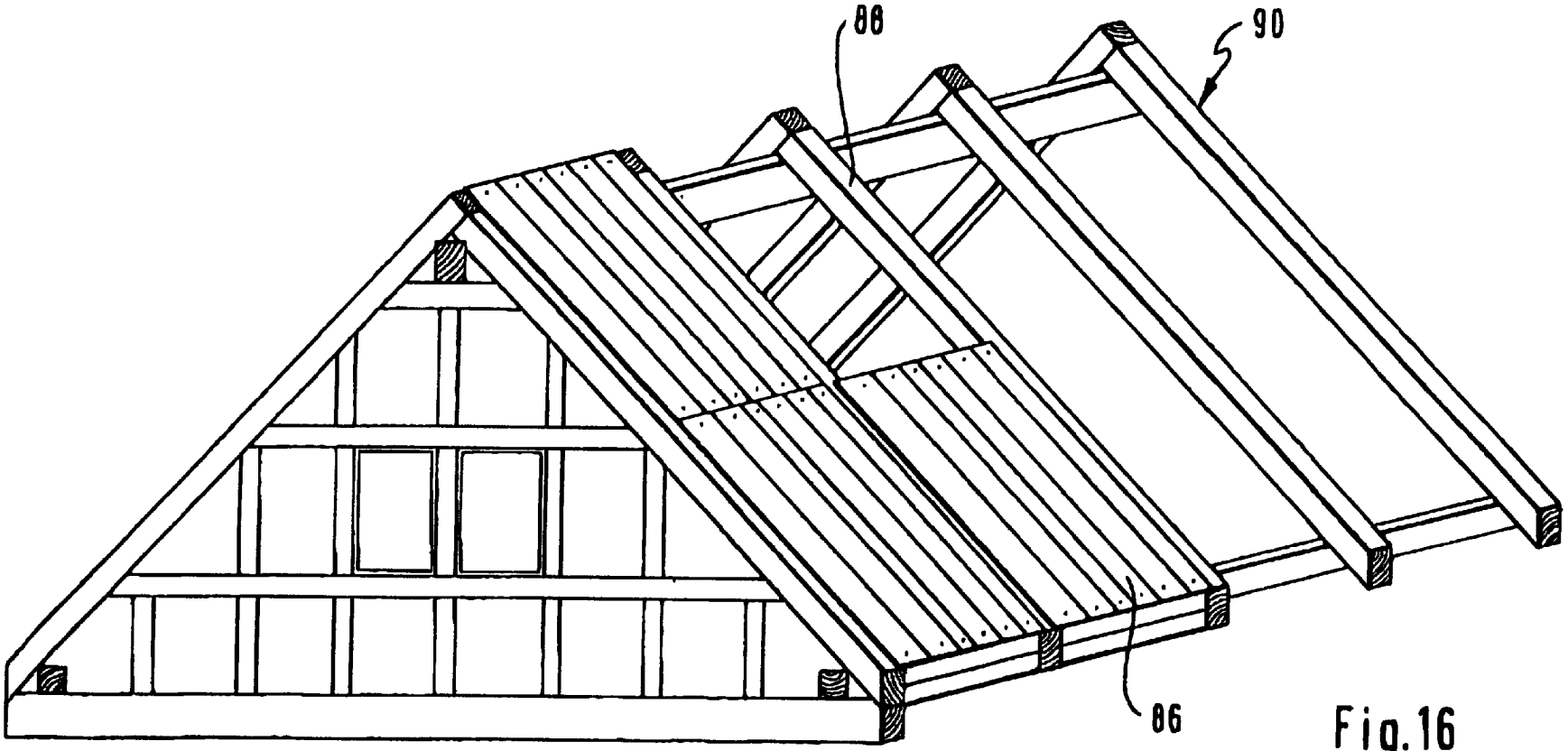

As can be seen in FIG. 16, the roofing elements 84 formed in such a way are inserted between adjacent rafters 88 of a roof structure 90.

Between the boards of the members, insulating material and/or fire breaks (fire resistance behavior according to German Industrial Standard DIN 4102) may be inserted.

In FIGS. 17 to 23 another embodiment of a compartment element 4 for use in construction of a wooden house in accordance with FIG. 1 is represented.

Figure 17:
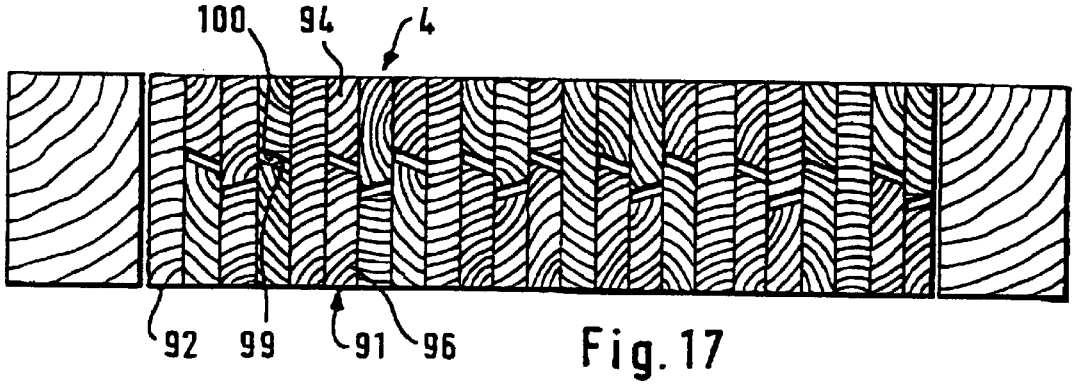
FIG. 17 shows a cross-sectional view of a second compartment element according to the invention comprised of transverse layers.

FIG. 17 shows a cross-sectional view of a like compartment element 4. Accordingly, this compartment element is comprised of a multiplicity of transverse strata 91 extending crosswise to the major surfaces 92 of the compartment element 4. The multiplicity of transverse layers 91 is interconnected by means of suitable connecting means, such as for example nails, clamps or by point-shaped adhesive bonding—e.g., by means of a lime-based adhesive.

Each transverse layer 91 consists of two wooden boards which are hereinafter referred to as layer boards 94, 96.

Figure 18:
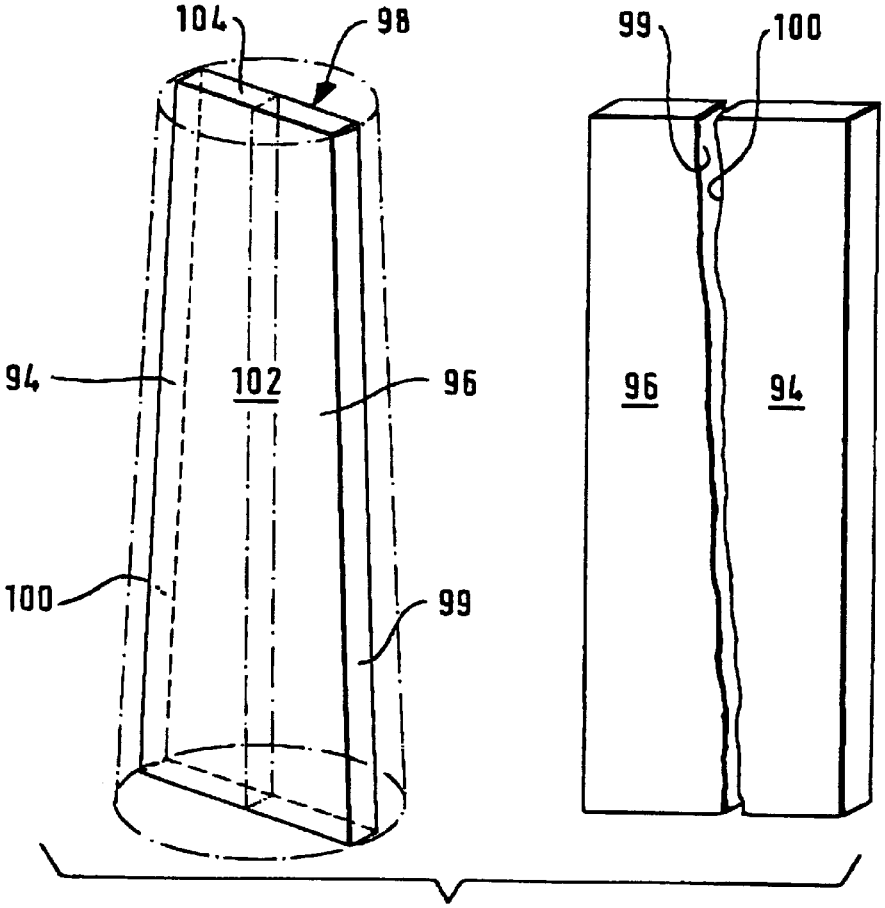
FIG. 18 shows the structure of a transverse layer of the compartment element of FIG. 17.

In FIG. 18 the production of such a transverse layer 91 including the two layer boards 94, 96 is represented.

Accordingly, a multiplicity of boards, only one of which is represented in FIG. 18, are sawed from a small-dimension timber of class II or III. Such a small-dimension timber board 98 thus has two bark edges 99, 100 which are constituted by the outer surfaces of the small-dimension timber. The major surfaces 102 and the front surfaces 104 are processed in the cutting step and possibly by a subsequent planing step, whereas of the bark edges 99, 100 are only stripped of bark and bast and dried (≦9% residual humidity). In the case of particularly high standards the bark edges may also be processed.

This small-dimension timber board 98 is sawed apart in the center along the dash-dotted line in FIG. 18 whereby two half board halves 94, 96 are obtained. The half board 96 is then rotated by 180° around its transverse axis (crosswise to the longitudinal axis) and placed beside the other half board 94 in such a way that the bark edge 100 is located opposite the bark edge 99.

Thanks to this rotation of the half board 94, the conicity of the small-dimension timber member may be compensated, resulting in a nearly square board, wherein predetermined dimensions may be observed by corresponding finishing or levelling of the bark edges 99, 100. The element comprised of the half boards 94, 96 shown on the right side in FIG. 18 thus results in a transverse layer 91 with the layer boards 94, 96 of the compartment element 4 in accordance with FIG. 17. The separating gap between the two bark edges 99, 100 may optionally be filled with insulation material. As a rule, however, a predetermined distance will be provided here.

As a result of the formation of the transverse layer 91 of small-dimension timber boards 98 according to the invention, more than 70% of a small-dimension timber log can be made use of for obtaining such transverse layers 91. Hereby a high-quality compartment element may be produced at minimum expense of material and production.

The manner of proceeding in accordance with the invention also permits the use of windbreak and the like timber for producing high-quality construction components. By using the transverse layers 91, panel elements having external dimensions of, e.g., 400 mm width and up to 9 m length may be obtained. Different dimensions, such as panels of 2×2 m may, of course, also be obtained, with the thickness of the transverse layer, depending on the function, being about 100 to 250 mm.

Figure 19:
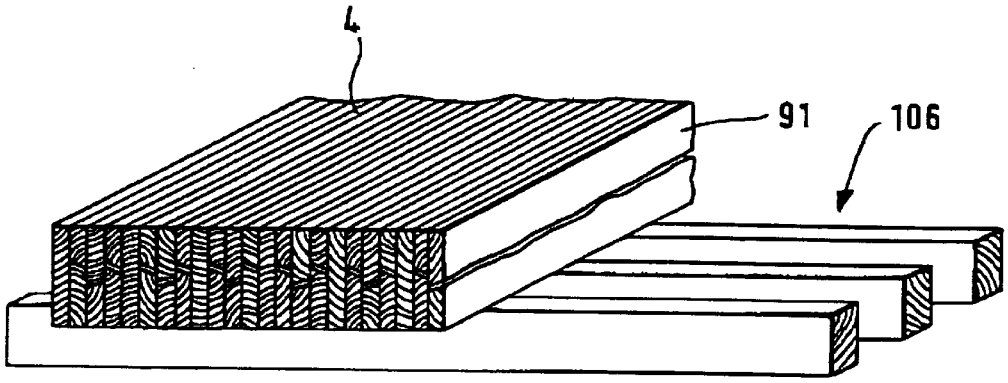
FIG. 19 shows an embodiment of the compartment element of FIG. 17 as a floor structure.

In FIG. 19 an example for the use of this compartment element 4 of the invention as a floor structure is represented. What is represented is a flooring on the ground floor wherein the structure represented in FIG. 19 is applied onto the pre-fabricated concrete floor instead of a floor pavement. To this end, initially a multiplicity of joists 106 are fixed at a parallel spacing with each other on the concrete floor, and on them the compartment element 4 according to the invention or a multiplicity of these compartment elements 4 are applied in a transverse orientation, wherein the lateral edges of the transverse layer 91 facing away from the joists 106 are planed. This are planed layer then forms the floor for the ground floor. Between the concrete and the joists 106 a waterproof sheeting may be provided. The spaced-apart joists 106 allow for optimum ventilation of the concrete floor.

Figure 20:
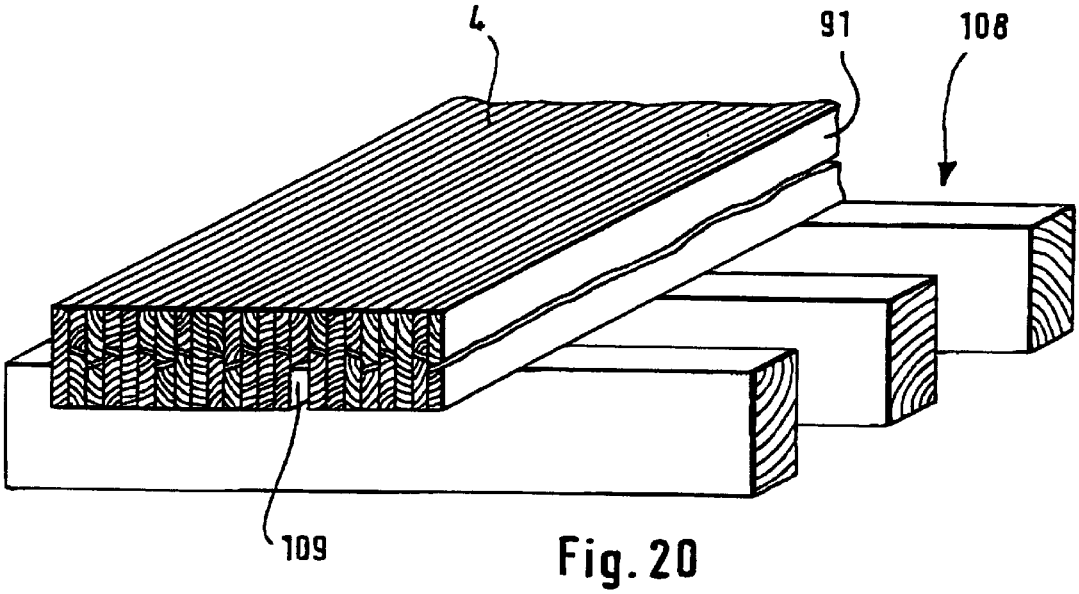
FIG. 20 shows an embodiment of the compartment element of FIG. 17 as a floor/ceiling structure.

In FIG. 20 a similar embodiment is represented wherein the compartment element 4 constituting the ceiling element is applied onto the beam layer 108 of the ceiling structure.

By planing the upper lateral edges of the transverse layer 91 shown in FIG. 20 it is, in turn, possible to produce a complete floor which may—optionally—moreover be provided with a cover.

By omitting one or several layer boards it is possible to form a recess 109 for providing sanitary, air conditioning and/or heating lines or conduits therein in the compartment element 4.

Figure 21:
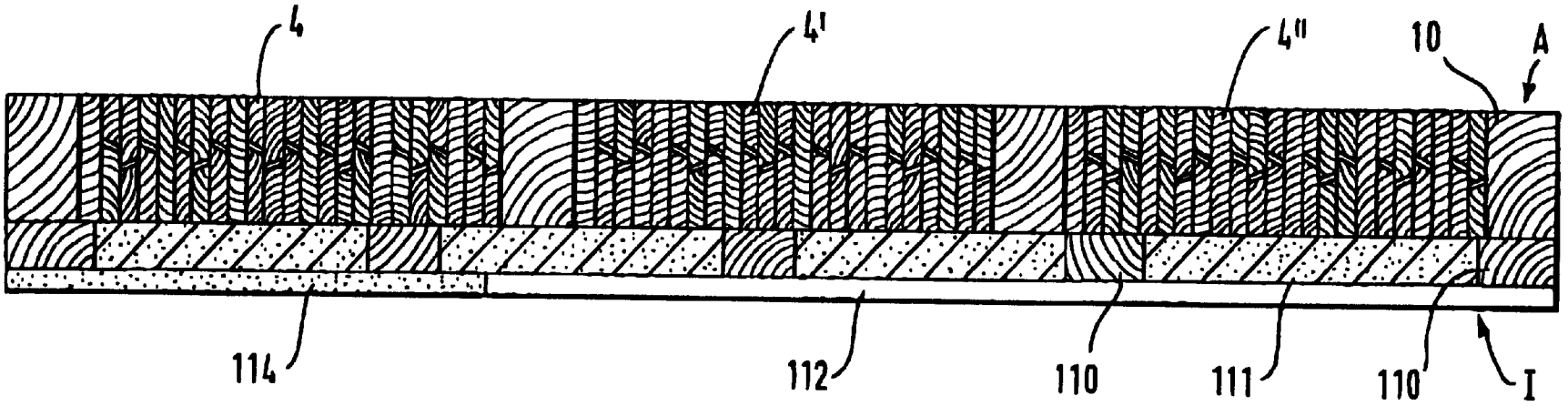
FIG. 21 shows an embodiment of the compartment element of FIG. 17 as an outer wall.

FIG. 21 shows an embodiment wherein the compartment elements 4, 4', 4" according to the invention are used for filling the interstices of a half-timber framework, of which only the vertical members 10 are visible.

When used as an outer wall, the separating gap between the bark edges 99, 100 (cf. FIG. 17) may be filled with mineral fiber. Onto the lower major surface of the half-timber construction shown in FIG. 21 (vertical members 10 and compartment elements 4 to 4"), which forms the inner wall I, supporting boards 110 arranged at a parallel distance from each other are applied, with an insulation 111 being provided between them. On the supporting boards 110 transverse strips 112 optionally including further intermediate insulation 114 are then formed. On these transverse strips 112 an inner wall, for example wooden panelling, gypsum tiles or a plaster base may then be applied.

As a matter of fact, the insulation ill may also in turn be provided on the outer wall A. This embodiment will presumably be preferred in practical application because the dew point should be shifted to the outside as far as possible.

Figure 22:
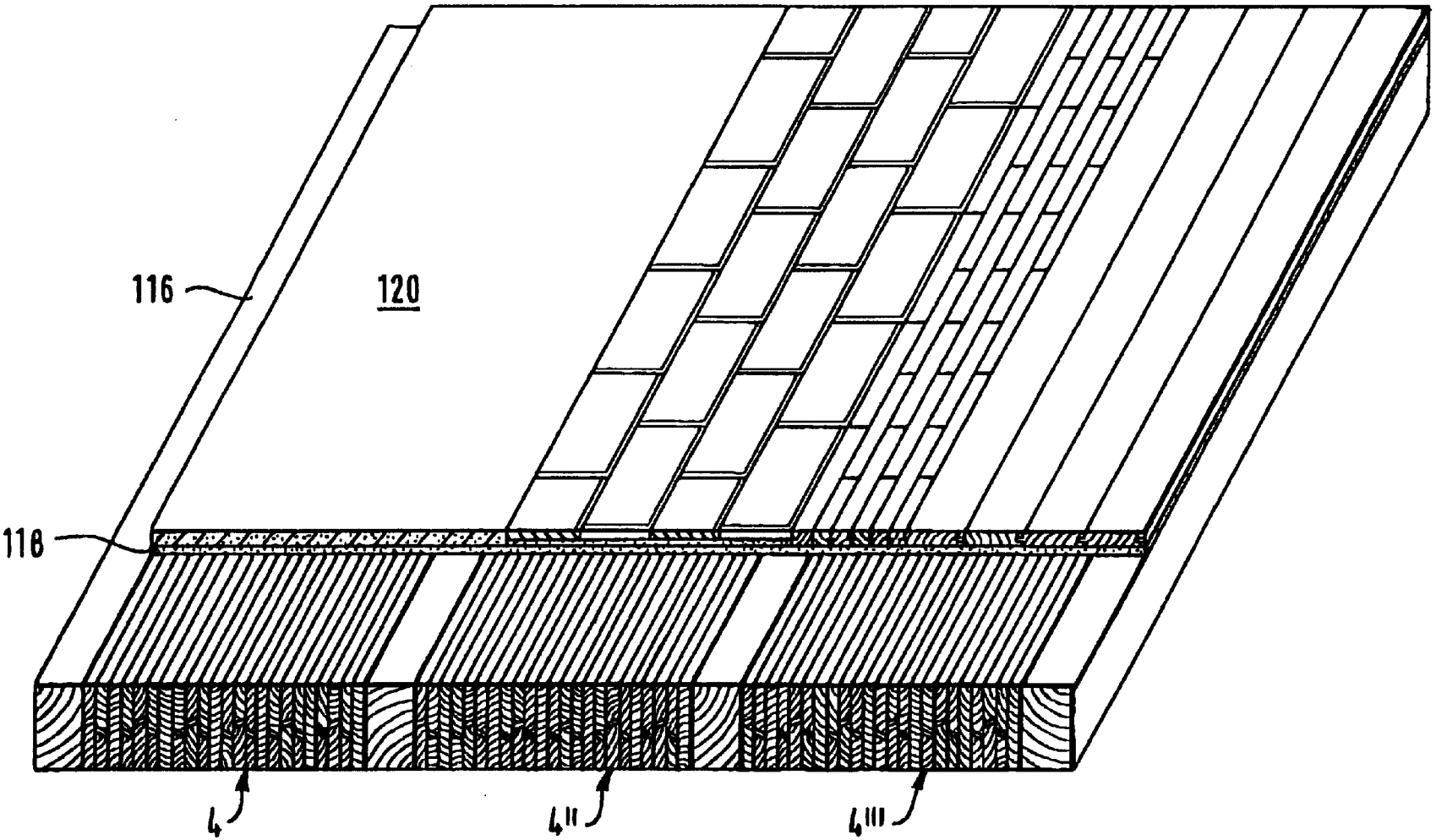
FIG. 22 shows an embodiment of the compartment element as a ceiling between ground floor and upper floor.

FIG. 22 shows an embodiment wherein the compartment elements 4, 4", 4'" are fastened between members 116.

On this compound construction of members 116 and compartment elements 4, 4" and 4'" a floor cover is then applied which, in the shown embodiment, may consist of an footfall sound insulation 118 and any desired floor structure 120 (wood flooring, clinker, etc.). In this embodiment the members 116 are formed by the unplaned ceiling joists of the ground floor.

In FIG. 23 a particularly "luxurious" embodiment of an outer wall is represented. This outer wall is formed by six compartment elements 4 to 4'''' according to the invention executed as a boarding of a corresponding half-timber frame with a double sheathing. Of this half-timber, in turn, only cross-sections of the vertical members 10 are visible.

In accordance with FIG. 23 two wall sections 122, 123, comprised of the compartment elements 4, 4', 4'", or 4'", 4'''', 4'''', are arranged at a parallel distance from each other, wherein the outer wall is formed by the compartment section 122 and the inner wall is formed by the compartment section 123. The separating gap between the two compartment elements 122, 123 is executed as an air gap having a width of approx. 2 to 4 cm.

On the inside as well as on the outside it is again possible to provide means for fastening an outer sheath or inner layers. Moreover it is again possible to create space for supply lines and conduits by omitting one or several layer boards. This variation is comparatively costly, however it exhibits excellent thermal and acoustic insulation properties, making its application appear sensible in high-quality structures with high requirements to thermal and acoustic protection.

The above described compartment elements 4 may, of course, also be used for filling out conventional half-timber constructions and particularly for the renovation of old buildings.

A particular advantage of the system according to the invention resides in the fact that the building owner may contribute a considerable amount of private work effort, and that material costs may be reduced to minimum owing to the use of small-dimension timber. Implementation of the half-timber frame system of the invention and of the compartment elements according to the invention creates a market for the small-dimension timbers which previously were practically useless and which can now be further processed immediately following their generation while not having to be stored in the forest any longer. As a result of these reduced storage periods, vermin such as the wood tick or the horntail are no longer left the time for attacking the small-dimension timbers to do away with treating the small-dimension timbers with pesticides.

I claim:

1. A compartment element, comprising:

a first sheathing layer (60);

a second sheathing layer (68);

at least two inner layers (8) disposed between the first sheathing layer and the second sheathing layer, each of the at least two inner layers including:

an insulation layer (64);

a layer of boards, the layer of boards including multiple boards (62) that are disposed parallel to each other; and spacer slats (66), the spacer slats of one of the at least two inner layers being in vertical alignment with the spacer slats of another of the at least two inner layers so as to space adjacent layers of boards from each other as well as to space the first sheathing layer and the second sheathing layer from respective adjacent layers of boards; and connecting means (71) for connecting the layers of boards and slats of the at least two inner layers, the first sheathing layer and the second sheathing layer.

2. The compartment element according to claim 1, wherein, in each of the at least two inner layers, said spacer slats (66) rest on said insulation layer (64).

3. The compartment element according to claim 2, wherein each of the first sheathing layer and the second sheathing layer is formed of a layer of boards (60).

4. The compartment element according to claim 3, further including final layers (70, 74, 76, 78, 80, 82) arranged on at least one of the first sheathing layer and the second sheathing layer (60, 68).

5. The compartment element according to claim 5, wherein the final layers (70, 74, 76, 78, 80, 82) define recesses capable of housing sanitary and/or air conditioning and/or electric installations.

6. The compartment element according to claim 1, wherein said connecting means include at least one of nails (71) and clamps.

7. A method for manufacturing the compartment element (4) of claim 1, comprising the steps of:

a) applying the first sheathing layer (60) on a mounting surface;

b) applying the insulation layer (64) of the one of the at least two inner layers;

c) applying the spacer slats (66) of the one of the at least two inner layers;

d) applying the layer of boards of the one of the at least two inner layers;

e) forming the other of the at least two inner layers in accordance with steps b) to d), wherein said spacer slats (66) of said other of the at least two inner layers are arranged in vertical alignment with the spacer slats of the one of the at least two inner layers;

f) forming the second sheathing layer (68); and g) connecting said layers of boards and spacer slats (66) of the at least two inner layers, the first sheathing layer and the second sheathing layer (60, 68).

8. The method according to claim 7, wherein the step of applying the first sheathing layer includes applying the first sheathing layer on a mounting table.

* * * * *